US008191203B2

(12) United States Patent
Yoo

(10) Patent No.: US 8,191,203 B2
(45) Date of Patent: Jun. 5, 2012

(54) DUST RECEPTACLE AND VACUUM CLEANER HAVING THE SAME

(75) Inventor: Dong-hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 299 days.

(21) Appl. No.: 12/154,290

(22) Filed: May 21, 2008

(65) Prior Publication Data

US 2009/0178230 A1 Jul. 16, 2009

Related U.S. Application Data

(60) Provisional application No. 61/011,341, filed on Jan. 16, 2008.

(30) Foreign Application Priority Data

Mar. 5, 2008 (KR) ..... 10-2008-0020612

(51) Int. Cl.
*A47L 9/20* (2006.01)

(52) U.S. Cl. ..... 15/352; 15/353

(58) Field of Classification Search ..... 15/352, 15/353

See application file for complete search history.

(56) References Cited

U.S. PATENT DOCUMENTS

| | | | | |
|---|---|---|---|---|
| 6,192,550 | B1 | 2/2001 | Hamada et al. | |
| 6,202,877 | B1 * | 3/2001 | La Torre et al. | 220/254.1 |
| 6,502,278 | B2 * | 1/2003 | Oh et al. | 15/353 |
| 2001/0054213 | A1 | 12/2001 | Oh et al. | |
| 2003/0121121 | A1 * | 7/2003 | Nakai et al. | 15/352 |
| 2004/0068827 | A1 * | 4/2004 | Dyson | 15/353 |
| 2005/0132530 | A1 | 6/2005 | Macleod et al. | |
| 2005/0229355 | A1 * | 10/2005 | Crouch et al. | 15/352 |
| 2006/0117520 | A1 | 6/2006 | Choi | |
| 2006/0200934 | A1 | 9/2006 | Go et al. | |
| 2007/0251050 | A1 * | 11/2007 | Harsh et al. | 15/352 |

FOREIGN PATENT DOCUMENTS

| | | | |
|---|---|---|---|
| GB | 2092472 | | 8/1982 |
| GB | 2413064 | | 10/2005 |
| JP | 2003019094 | | 1/2003 |
| JP | 2003019094 | A * | 1/2003 |
| JP | 2003079545 | | 3/2003 |
| JP | 2004049792 | | 2/2004 |
| JP | 2004049792 | A * | 2/2004 |
| JP | 2005-087507 | | 4/2005 |
| JP | 2006-061544 | | 3/2006 |

OTHER PUBLICATIONS

British Combined Search and Examination Report dated Dec. 16, 2008 corresponding to Application No. GB0815591.3.

* cited by examiner

*Primary Examiner* — Bryan R Muller
(74) *Attorney, Agent, or Firm* — Ohlandt, Greeley, Ruggiero & Perle, LLP

(57) ABSTRACT

A dust receptacle having a receptacle body that may be attached to and detached from a cleaner body is disclosed. The dust receptacle includes the bottom of which is opened; a handle, which is disposed on the receptacle body in a longitudinal direction; an exhaust cover, an end of which is hinged with a lower end of the handle, and which is used to expose a bottom of the receptacle body; and an operating lever that locks or unlocks the exhaust cover.

17 Claims, 5 Drawing Sheets

DUST RECEPTACLE AND VACUUM CLEANER HAVING THE SAME

CROSS-REFERENCE TO RELATED APPLICATIONS

This application claims priority from U.S. Provisional Patent Application No. 61/011,341, filed on Jan. 16, 2008, in the United States Patent and Trademark Office, and from Korean Patent Application No. 10-2008-0020612, filed on Mar. 5, 2008, in the Korean Intellectual Property Office, the entire disclosure of both of which are incorporated herein by reference.

BACKGROUND OF THE INVENTION

1. Field of the Invention

Aspects of the present disclosure relate to a dust receptacle of a vacuum cleaner for collecting dust separated from air, and more particularly, to a dust receptacle in which the collected dust is discharged downwards, and a vacuum cleaner having the same.

2. Description of the Related Art

Vacuum cleaners generally have dust receptacles that may be attached to and detached from the vacuum cleaner so as to collect dust separated by a cyclone unit of the vacuum cleaner.

A conventional dust receptacle is mounted in a vacuum cleaner, connected to an exhaust unit of the cyclone unit, and collects the dust discharged from the cyclone unit. When the dust receptacle removes the collected dust, a user grasps the dust receptacle with one hand, and opens a cover to expose an exhaust hole of the dust receptacle with the other hand in order to remove the dust.

However, such a conventional manner of removing the collected dust is inconvenient and unsanitary since a user needs to use both hands in order to open the cover, and must touch the cover.

SUMMARY OF THE INVENTION

An aspect of the present disclosure is to address at least the above problems and/or disadvantages and to provide at least the advantages described below.

Accordingly, an aspect of the present disclosure is to provide a dust receptacle for a vacuum cleaner in which a user presses a button provided to a handle while grasping the handle to open an exhaust door, so the dust collected in the dust receptacle can be removed downwards, and a vacuum cleaner having the same.

In accordance with an aspect of the present disclosure, there is provided a dust receptacle that is attached to and detached from a cleaner body, the dust receptacle including a receptacle body, the bottom of which is opened; a handle, which is disposed on the receptacle body in a longitudinal direction; an exhaust cover, an end of which is hinged with a lower end of the handle, and which is used to expose a bottom of the receptacle body; and an operating lever that locks or unlocks the exhaust cover.

The operating lever may include a first operating member that is slidably disposed along an inside of the handle, and an upper end of which is exposed above the handle to be pressed by a user; and a second operating member that is elastically and slidably disposed on an outer bottom surface of the exhaust cover to operate in tandem with the first operating member.

The handle may be formed in a straight or curved shape.

The first operating member may be formed in a straight or curved shape so as to correspond to the shape of the handle.

The second operating member may include a contact surface of which a side contacting a lower end of the first operating member is angled.

A side of the second operating member may contact a lower end of the first operating member, and another side may include a hook locked to a protrusion that is opposed to the handle and protrudes from a lower end of the receptacle body.

The second operating member may be elastically supported on the exhaust cover by a return spring, and an end of the return spring may be fixed to a portion of the second operating member, and the opposite end of the return spring may be supported on the protrusion that protrudes from a bottom surface of the exhaust cover, so that the second operating member may be elastically supported on the first operating member.

The handle may include an extension portion that is formed higher than the upper end of the first operating member.

The upper end of the first operating member may be disposed lower than the upper end of the handle.

An upper portion of the first operating member may be elastically supported on the inside of the handle.

In accordance with an aspect of the present disclosure, there is provided a vacuum cleaner including a suction port assembly that draws in dust-laden air from a surface being cleaned; a cleaner body that is connected to the suction port assembly, and comprises a suction source thereinside; and a dust receptacle that is attached to and detached from a casing of the cleaner body, wherein the dust receptacle may include a receptacle body, the bottom of which is opened; a handle, which is disposed on the receptacle body in a longitudinal direction; an exhaust cover, an end of which is hinged with a lower end of the handle, and which is used to expose a bottom of the receptacle body; and an operating lever that locks or unlocks the exhaust cover.

The operating lever may include a first operating member that is slidably disposed along an inside of the handle, and an upper end of which is exposed above the handle to be pressed by a user; and a second operating member that is elastically and slidably disposed on an outer bottom surface of the exhaust cover to operate in tandem with the first operating member.

The handle may be formed in a straight or curved shape.

The first operating member may be formed in a straight or curved shape so as to correspond to the shape of the handle.

The second operating member may include a contact surface of which a side contacting a lower end of the first operating member is angled.

A side of the second operating member may contact a lower end of the first operating member, and another side may include a hook locked to a protrusion that is opposed to the handle and protrudes from a lower end of the receptacle body.

The second operating member may be elastically supported on the exhaust cover by a return spring, and an end of the return spring may be fixed to a portion of the second operating member, and the opposite end of the return spring may be supported on the protrusion that protrudes from a bottom surface of the exhaust cover, so that the second operating member is elastically supported on the first operating member.

The handle may include an extension portion that is formed higher than the upper end of the first operating member.

The upper end of the first operating member may be disposed lower than the upper end of the handle.

An upper portion of the first operating member may be elastically supported on the inside of the handle.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
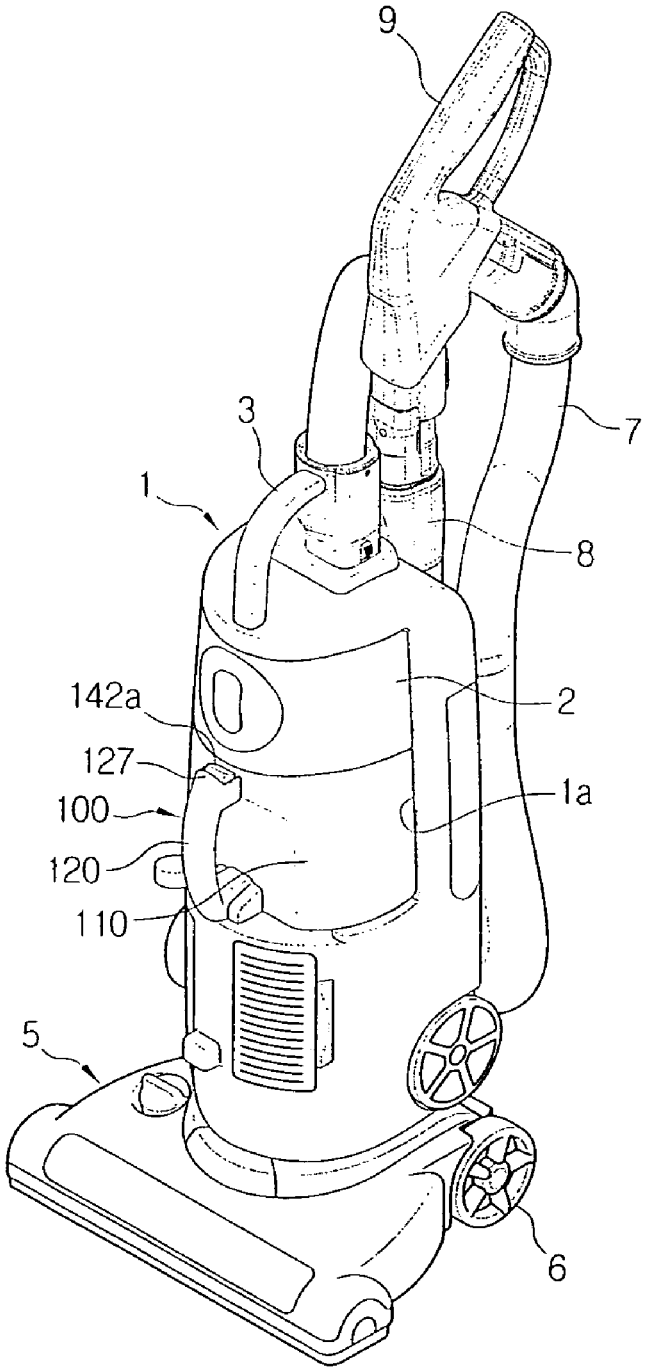
FIG. 1 is a perspective view illustrating a vacuum cleaner according to an exemplary embodiment of the present disclosure having a dust receptacle mounted therein.
Figure 2:
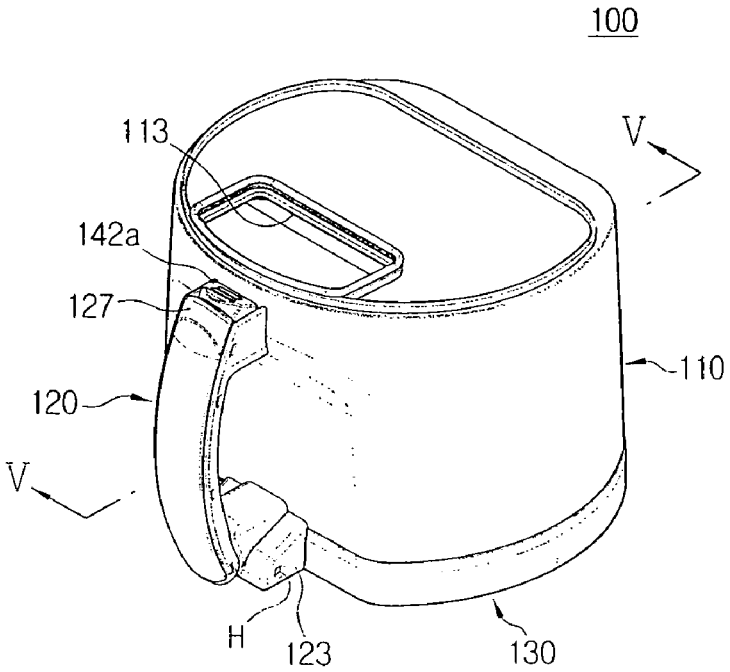
FIG. 2 is a top perspective view illustrating a dust receptacle according to an exemplary embodiment of the present disclosure.
Figure 3:
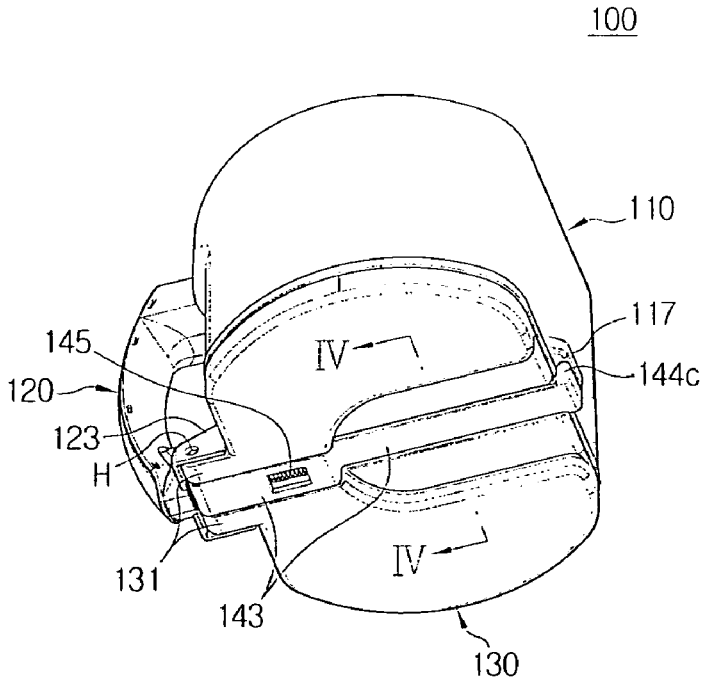
FIG. 3 is a bottom perspective view of the dust receptacle of FIG. 2.

Hereinafter, an embodiment of the present disclosure will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the disclosure. Thus, it is apparent that the present disclosure can be carried out without those defined matters. Also, well-known functions or constructions are not described in detail since they would obscure the disclosure in unnecessary detail.

A dust receptacle according to an exemplary embodiment of the present disclosure and a vacuum cleaner having the same will be described with reference to FIGS. 1 to 7.

Referring to FIG. 1, an upright vacuum cleaner according to an exemplary embodiment of the present disclosure may include a cleaner body 1, a suction port assembly 5, an extension pipe 8, and an operational handle 9.

The cleaner body 1 has a dust receptacle 100 that may be attached to and detached from a casing 1*a*. A cyclone unit 2 to separate dust-laden air using centrifugal force is disposed in n an upper portion of the casing 1*a*. The cleaner body 1 has a carrying handle 3 on an upper portion thereof, and a suction motor (not shown) thereinside.

A suction port (not shown) to draw in external air laden with dust from a surface being cleaned is formed on a bottom surface of the suction port assembly 5. The suction port assembly 5 has a hinge portion (not shown) at the rear, and a lower end of the extension pipe 8 is connected so as to be attached to and detached from the hinge portion (not shown). The suction port assembly 5 has wheels 6 at the rear left and right sides.

The operational handle 9 is provided in order to easily move the upright vacuum cleaner over a surface being cleaned. One end of the operational handle 9 is connected to an upper end of the extension pipe 8, and the other end is connected to a hose 7. The hose 7 is connected to the cleaner body 1. This enables the cleaner body 1 to be separated from the extension pipe 8, and the extension pipe 8 to be separated from the hinge portion (not shown), so the cleaner body 1 can be used as a canister type vacuum cleaner.

The upright vacuum cleaner described above is merely an example to explain a dust receptacle 100 according to the exemplary embodiment of the present disclosure. The dust receptacle 100 explained below may be applied to either on upright vacuum cleaner or a canister vacuum cleaner.

The dust receptacle 100 according to an exemplary embodiment of the present disclosure will be explained in detail with reference to FIGS. 2 to 5.

The dust receptacle 100 may include a receptacle body 110, a handle 120, an exhaust cover 130, and an operating lever 140.

The receptacle body 110 includes a dust-collecting chamber 110*a* in which dust D discharged from the cyclone unit 2 is collected. An upper plate 111 covers an upper portion of the receptacle body 110, and an opening 110*b* (referring to FIG. 7) is formed at the bottom of the receptacle body 110 to remove the collected dust. A dust inlet 113 is formed on the upper plate 111 to collect the dust separated from the air by the cyclone unit 2.

The handle 120 is used to detach the dust receptacle 100 from the casing 1*a* of the cleaner body 1, or to carry the dust receptacle 100. The handle 120 is vertically disposed at the side of the receptacle body 110, and upper and lower ends thereof are fixed to upper and lower portions of the receptacle body 110, respectively. The handle 120 has a space 121 in which a first operating member 141 of the operating lever 140 is disposed.

The exhaust cover 130 closes the opening 110*b* that is disposed at the bottom of the receptacle body 110, and opens the opening 110*b* to remove the dust D collected in the receptacle body 110. An end 131 of the exhaust cover 130 is rotatably hinged about a lower protrusion 123 of the handle 120 by a hinge pin H.

Figure 4:
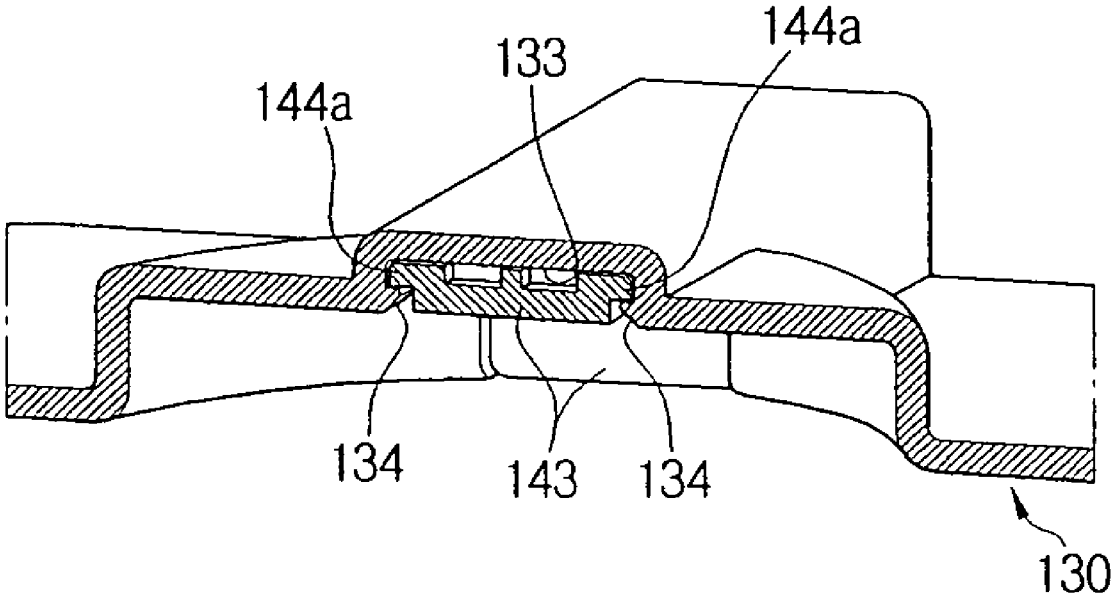
FIG. 4 is an enlarged sectional view taken along line IV-IV of FIG. 3.
Figure 5:
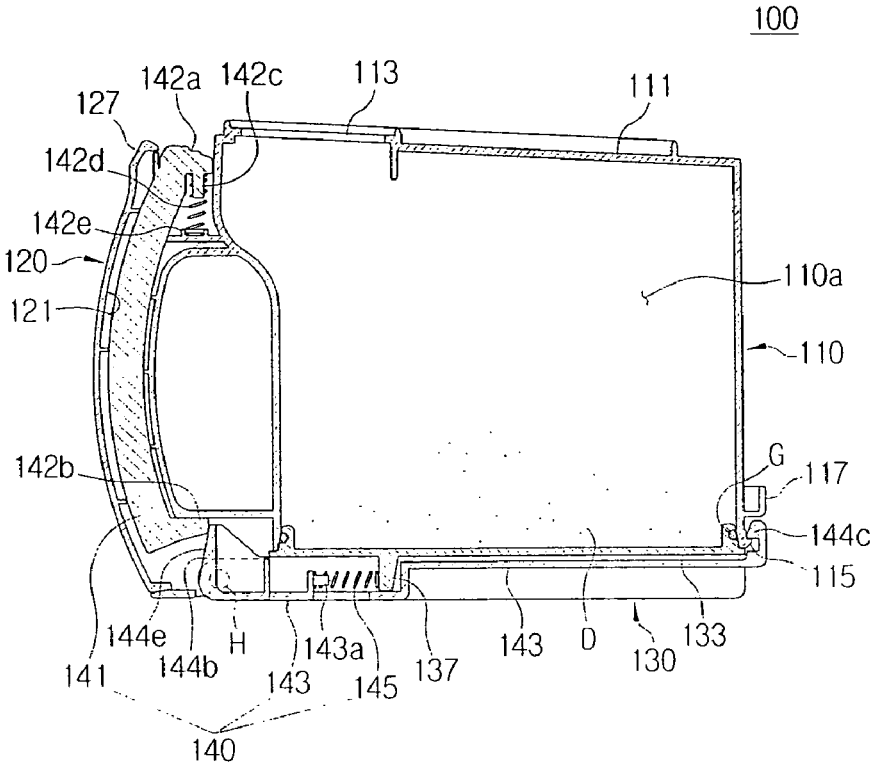
FIG. 5 is a sectional view taken along line V-V of FIG. 2.

Referring to FIG. 4, the exhaust cover 130 includes a guide rail groove 133 that crosses the bottom center of the receptacle body 110. A second operating member 143 of the operating lever 140 is slidably connected to the guide rail groove 133. Referring to FIG. 5, a gasket G seals the area between an inner circumference of the receptacle body 110 and an outer circumference of the exhaust cover 130 to prevent the dust D collected in the dust-collecting chamber 110*a* from leaking.

The operating lever 140 includes the first operating member 141, which is disposed in the space 121 of the handle 120, and the second operating member 143, which is elastically disposed on an outer bottom surface of the exhaust cover 130.

Referring to FIG. 5, the first operating member 141 corresponds in shape to the handle 120, and is slidably disposed in the space 121. The first operating member 141 includes a button 142*a* on an upper end thereof which may be pressed by a user, and a pressure projection 142*b* on a lower end thereof which protrudes to the second operating member 143, in order to press an end 144*b* of the second operating member 143.

The button 142*a* is exposed above the handle 120. The button 142*a* may be disposed lower than an upper end of the handle 120, or the extension portion 127 of the handle 120 may be disposed higher than an upper surface of the button 142*a*, in order to prevent a user from unintentionally pressing the button 142*a*. A coil spring 142*d* elastically supports an area between a lower portion of the button 142*a* and an inner portion of the handle 120. An end of the coil spring 142*d* is fixed to a fixing protrusion 142*c* that protrudes from the bottom of the button 142, and the other end is fixed to a fixing groove 142*e* formed inside the handle 120.

The second operating member 143 is slidably disposed on the guide rail groove 133 of the exhaust cover 130. The second operating member 143 includes a protrusion 144*a* on both sides thereof not to secede from the guide rail groove 133, and the guide rail groove 133 includes a pair of projections 134 that are engaged with a pair of protrusions 144*a* as shown in FIG. 4.

The second operating member 143 forms at the end 144*b* thereof a contact surface 144*e* that contacts the pressure projection 142*b* of the first operating member 131, so that the first operating member 141 slides downward following the movement of the handle 120, the pressure projection 142*b* moves toward the end 144*b* of the second operating member 143, and thus the second operating member 143 moves with the pressure projection 142*b*. The contact surface 144*e* is angled toward the second operating member 143 at a predetermined angle. If the handle 120 is formed in a linear configuration instead of the curved configuration illustrated in FIG. 5, the inclination of the contact surface 144*e* causes the pressure projection 142*b* of the first operating member 141 that vertically moves to press the contact surface 144*e*, and thus the second operating member 143 moves with the first operating member 141.

However, the handle 120 is formed in a curved configuration in this exemplary embodiment of the present disclosure. Accordingly, when the first operating member 141 slides downward, the pressure projection 142*b* of the first operating member 141 moves horizontally instead of vertically, so it is unnecessary for the contact surface 144*e* of the second operating member 142 to be angled.

The second operating member 143 forms at the other end a hook 144*c* that engages with a protrusion 115. A protection protrusion 117 is formed over the protrusion 115 to prevent the hook 144*c* from being detached from the protrusion 115 by an unexpected force.

A return spring 145 causes the second operating member 143 to be elastically provided on the exhaust cover 130. Specifically, one end of the return spring 145 is fixed to a fixing protrusion 137 that protrudes toward the lower surface of the exhaust cover 130, and the other end is fixed to a:supporting protrusion 143*a* of the second operating member 143. The return spring 145 pushes the second operating member 143 toward the first operating member 141, so elastically supports the second operating member 143 while the exhaust cover 130 closes the opening 110*b* of the receptacle body 110. Accordingly, the hook 144*c* of the second operating member 143 stably engages with the protrusion 115 of the receptacle body 110. The protrusion 115 is separated into three pieces to be elastically engaged with the hook 144*c*.

While this exemplary embodiment of the present disclosure provides a coil spring 142*d* that elastically supports the button 142*a* of the first operating member 141 in the inside of the handle 120, and a return spring 145 that elastically supports the second operating member 143 on the exhaust cover 130, the return spring 145 may perform the functions of both the return spring 145 and the coil spring 142*d*.

The process of removing the dust collected in the dust receptacle 110*a* by opening the exhaust cover 130 of the dust receptacle 100 according to the exemplary embodiment of the present disclosure will be explained with reference to FIGS. 5 to 7.

The dust receptacle 100 is attached to the casing 1*a* of the cleaner body 1 while a user is cleaning. The dust receptacle 100 collects the dust D discharged from the cyclone unit 2 in the dust-collecting chamber 110*a* through the dust inlet 113 while the exhaust cover 130 closes the opening 110*b* of the receptacle body 110.

To remove the dust D collected in the dust-collecting chamber 110*a*, a user detaches the receptacle body 110 from the casing 1*a* of the cleaner body 1, and moves to the dumping place while grasping the handle 120 of the dust receptacle 100.

Figure 6:
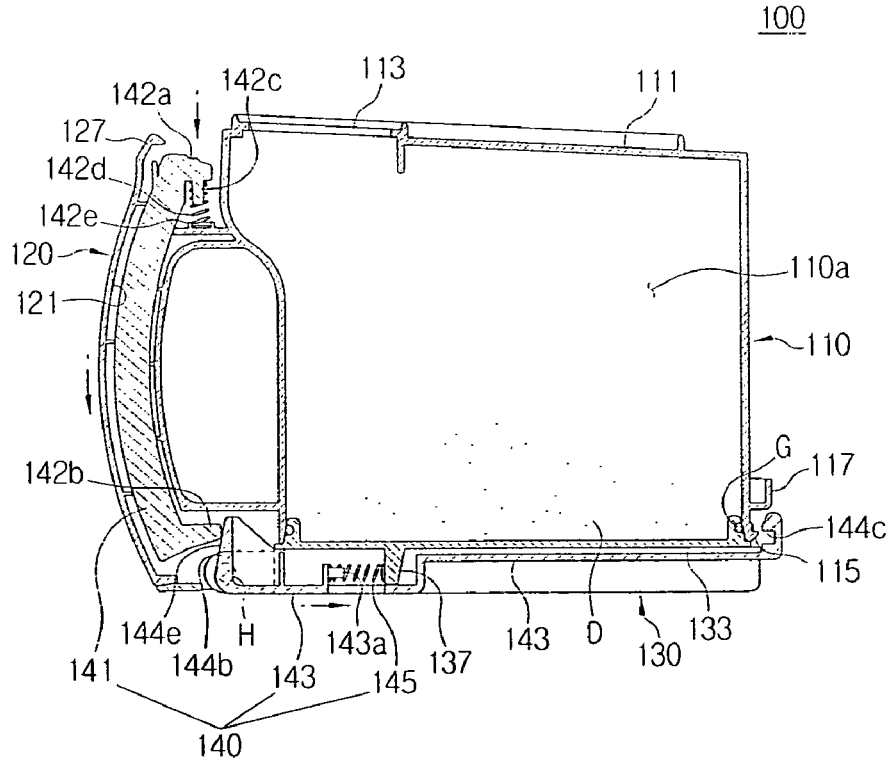
FIG. 6 is a sectional view illustrating a dust receptacle in which a user presses a button of a first operating member.
Figure 7:
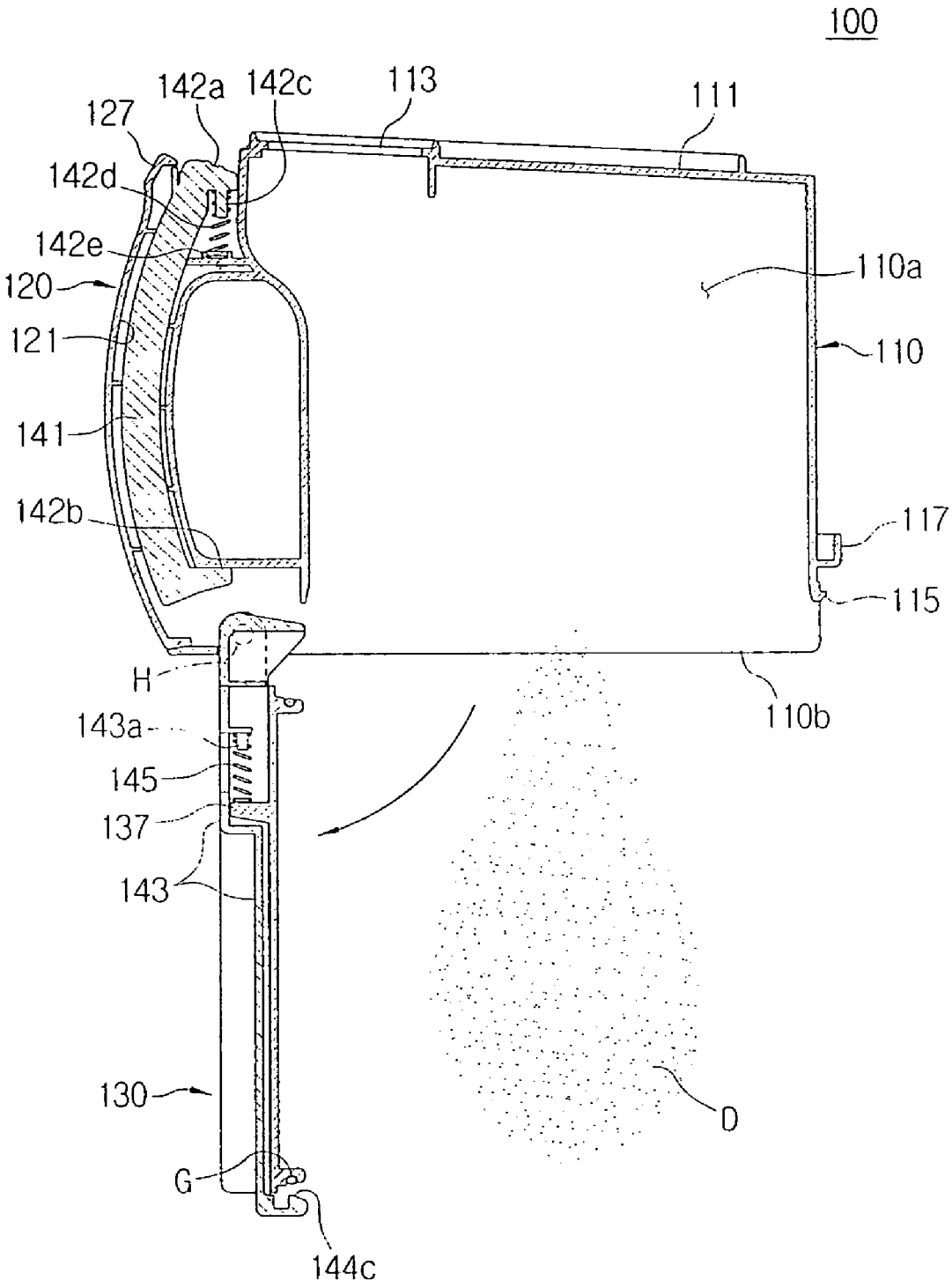
FIG. 7 is a sectional view illustrating a dust receptacle in which an exhaust cover is opened.

A user presses the button 142*a* of the first operating member 141 with a digit of a hand used to grasp the handle 120, for example with a thumb as shown in FIG. 6. The coil spring 142*d* elastically supports the button 142*a*, and the first operating member 141 slides downward following the space 121 of the handle 120.

The pressure projection 142*b* of the first operating member 141 pushes an end 144*b* of the second operating member 143 to the rear of the receptacle body 110. The return spring 145 elastically supports the second operating member 143 on the exhaust cover 130, and the second operating member 143 slides following the guide rail groove 133 of the exhaust cover 130.

The hook 144*c* of the second operating member 143 is disengaged from the protrusion 115 of the receptacle body 110. The exhaust cover 130 rotates about the hinge pin H due to its own weight, and opens the opening 110*b* of the receptacle body 110. The dust D collected in the dust-collecting chamber 110*a* is discharged to the outside through the opening 110*b*.

The exhaust cover 130 is opened from the direction opposite the handle 120 that is grasped by the user, that is from the rear portion of the dust receptacle 100, so the discharged dust is prevented from being dissipated in the direction of the user.

According to the exemplary embodiment of the present disclosure, a user may grasp the dust receptacle 100, and conveniently open the exhaust cover 130 with one hand.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A dust receptacle that is configured to be attached to and detached from a cleaner body, the dust receptacle comprising:

a receptacle body having a lower end that is open;

a handle being disposed on a first side the receptacle body in a longitudinal direction;

an exhaust cover having a first end hinged to a lower end of the handle, the exhaust cover movable between first and second positions either to expose the lower end of the receptacle body or to close the lower end of the receptacle body; and an operating lever locking or unlocking the exhaust cover, wherein the operating lever comprises:

a first operating member that is slidably disposed along an inside of the handle, the first operating member having an upper end disposed lower than an upper end of the handle and an upper end of the receptacle body, and the upper end of the first operating member exposed from above the handle to be pressee by a user; and a second operating member that is elastically and slidably disposed on an outer bottom surface of the exhaust cover to operate in tandem with the first operating member, the second operating member being retractable toward the first operating member to secure a second end of the exhaust cover to a second side of the dust receptacle in a closed position and extendable away from the first operating member to unsecure the second end of the exhaust cover from the second side of the dust receptacle to open the lower end, the second side of the dust receptacle being opposite from the first side having the handle.

2. The dust receptacle of claim 1, wherein the handle is formed in a curved shape.

3. The dust receptacle of claim 2, wherein the first operating member is formed in a curved shape so as to correspond to the shape of the handle.

4. The dust receptacle of claim 3, wherein the second operating member comprises a contact surface having a side contacting a lower end of the first operating member, wherein the side is angled relative to a longitudinal direction of the first operating member.

5. The dust receptacle of claim 1, wherein the second operating member comprises a side that contacts a lower end of the first operating member and another side comprising a hook, the hook being lockable to a protrusion that is opposed to the handle and protrudes from a lower end of the receptacle body.

6. The dust receptacle of claim 1, wherein the second operating member is elastically supported on the exhaust cover by a return spring, and an end of the return spring is fixed to a portion of the second operating member, and the opposite end of the return spring is supported on a protrusion that protrudes from a bottom surface of the exhaust cover, so that the second operating member is elastically supported on the first operating member.

7. The dust receptacle of claim 1, wherein the handle comprises an extension portion that extends from the upper end of the handle.

8. The dust receptacle of claim 1, wherein the first operating member has an upper portion that is elastically supported on the inside of the handle.

9. A vacuum cleaner, comprising:

a suction port assembly that draws in dust-laden air from a surface being cleaned;

a cleaner body that is connected to the suction port assembly; and a dust receptacle that is attached to and detached from a casing of the cleaner body, wherein the dust receptacle comprises:

a receptacle body having a lower end that is open;

a handle being disposed on a first side the receptacle body in a longitudinal direction;

an exhaust cover having a first end hinged to a lower end of the handle, the exhaust cover being movable between first and second positions either to expose a lower end of the receptacle body or to close the lower end of the receptacle body; and an operating lever that locks or unlocks the exhaust cover, wherein the operating lever comprises:

a first operating member that is slidably disposed along an inside of the handle, the first operating member having an upper end disposed lower than an upper end of the handle and an upper end of the receptacle body, and the upper end of the first operating member exposed from above the handle to be pressed by a user; and a second operating member that is elastically and slidably disposed on an outer bottom surface of the exhaust cover to operate in tandem with the first operating member, the second operating member being retractable toward the first operating member to secure a second end of the exhaust cover to a second side of the dust receptacle in a closed position and extendable away from the first operating member to unsecure the second end of the exhaust cover from the second side of the dust receptacle to open the lower end, the second side of the dust receptacle being opposite from the first side having the handle.

10. The vacuum cleaner of claim 9, wherein the handle is formed in a curved shape.

11. The vacuum cleaner of claim 10, wherein the first operating member is formed in a curved shape so as to correspond to the shape of the handle.

12. The vacuum cleaner of claim 11, wherein the second operating member comprises a contact surface having a side contacting a lower end of the first operating member, wherein the side is angled relative to a longitudinal direction of the first operating member.

13. The vacuum cleaner of claim 9, wherein the second operating member has a side that contacts a lower end of the first operating member and another side comprising a hook, the hook being lockable to a protrusion that is opposed to the handle and protrudes from a lower end of the receptacle body.

14. The vacuum cleaner of claim 9, wherein the second operating member is elastically supported on the exhaust cover by a return spring, and an end of the return spring is fixed to a portion of the second operating member, and the opposite end of the return spring is supported on a protrusion that protrudes from a bottom surface of the exhaust cover, so that the second operating member is elastically supported on the first operating member.

15. The vacuum cleaner of claim 9, wherein the handle comprises an extension portion that extends from the upper end of the handle.

16. The vacuum cleaner of claim 9, wherein the first operating member has an upper portion that is elastically supported on the inside of the handle.

17. A vacuum cleaner, comprising:

a suction port assembly;

a cleaner body having a casing and being connected to the suction port assembly;

a dust receptacle removably attached to the casing, the dust receptacle having a handle attached to a first side of the dust receptacle, an open lower end, and an exhaust cover, a first end of the exhaust cover being hinged to a lower end of the handle and being pivotable to either open or close the open lower end of the dust receptacle;

a first operating member slidably disposed inside of the handle, the first operating member having an upper end disposed lower than an upper end of the handle; and a second operating member slidably disposed on an outer bottom surface of the exhaust cover, the second operating member being retractable toward the first operating member to secure a second end of the exhaust cover to a second side of the dust receptacle in a closed position and extendable away from the first operating member to unsecure the second end of the exhaust cover from the second side of the dust receptacle to open the open lower end, the second side of the dust receptacle being opposite to the first side having the handle.

* * * * *